US010109144B2

(12) United States Patent
Lin

(10) Patent No.: US 10,109,144 B2
(45) Date of Patent: Oct. 23, 2018

(54) COMPLEX BEVERAGE GRABBING VENDING MACHINE AND METHOD FOR SELLING BEVERAGES THROUGH THE SAME

(71) Applicant: Yi-Ho Lin, Kaohsiung (TW)

(72) Inventor: Yi-Ho Lin, Kaohsiung (TW)

( * ) Notice: Subject to any disclaimer, the term of this patent is extended or adjusted under 35 U.S.C. 154(b) by 0 days.

(21) Appl. No.: 15/641,339

(22) Filed: Jul. 5, 2017

(65) Prior Publication Data

US 2018/0204408 A1 Jul. 19, 2018

(30) Foreign Application Priority Data

Jan. 17, 2017 (TW) ..... 106101544 A

(51) Int. Cl.
*G07F 11/00* (2006.01)
*G07F 9/04* (2006.01)
*G07F 11/42* (2006.01)

(52) U.S. Cl.
CPC ..... *G07F 11/005* (2013.01); *G07F 9/04* (2013.01); *G07F 11/42* (2013.01)

(58) Field of Classification Search
CPC .... A63F 9/30; G07F 17/3251; G07F 17/3253; G07F 17/3255; G07F 17/3297; G07F 17/34; G06Q 30/0209
USPC ..... 221/123, 143; 273/447
See application file for complete search history.

(56) References Cited

U.S. PATENT DOCUMENTS

2003/0151202 A1* 8/2003 Fisher ..... A63F 9/30 273/447
2008/0088092 A1* 4/2008 Todokoro ..... A63F 9/30 273/447
2010/0102078 A1* 4/2010 Mosey ..... G07F 9/105 221/115

* cited by examiner

*Primary Examiner* — Timothy R Waggoner
*Assistant Examiner* — Ayodeji T Ojofeitimi
(74) *Attorney, Agent, or Firm* — Leong C. Lei

(57) ABSTRACT

A complex beverage grabbing vending machine includes a machine table and a plurality of bottle mounting frames. The machine table is configured with an accommodation space having a drop port with a detection element, and the upper side of the accommodation a crown block track to which a gripper with non-slip elements is coupled pivotally; the gripper is configured with a hanging line capable of wound to shorten or unwound to elongate; the machine table is further configured with an operation station having an operation lever and operation button, coin slot in electric communication with the operation station and gripper, refund button, and an extract port in communication the drop port; the bottle mounting frames each having a plurality of mounting holes are configured in the accommodation space. Whereby, the present invention is capable of beverage sale and has game fun.

1 Claim, 7 Drawing Sheets

COMPLEX BEVERAGE GRABBING VENDING MACHINE AND METHOD FOR SELLING BEVERAGES THROUGH THE SAME

TECHNICAL FIELD OF THE INVENTION

The present invention relates to a complex beverage grabbing vending machine and a method for selling beverages through the machine, capable of beverage sale and having game fun at the same time.

DESCRIPTION OF THE PRIOR ART

Conventional beverage vending machines have a machine table capable of the storage of a variety of beverages, on which a display window is configured, where a button is installed below each beverage. Therefore, a customer pays the amount of money corresponding to a beverage to be purchase stored in the machine table and then pushes down the button, the beverage will be output to an extract port configured on the machine table, and the customer can then take out the beverage.

The beverage vending machines mentioned above have a function of selling beverages, but they only provide one-way sale without any interaction between the machines and customers, which is too monotonous, cold and boring for customers. To increase customers' buying pleasure, a display screen used to play commercial movies, animations or music is currently installed on some vending machines, respectively, thereby attracting customers' attention. However, customers still do the purchase of a beverage in the same way as the one mentioned above, it is still monotonous, cold and boring for customers.

SUMMARY OF THE INVENTION

The main object of the present invention is to provide a complex beverage grabbing vending machine, capable of beverage sale and having game fun at the same time.

To achieve the object mentioned above, the present invention proposes a complex beverage grabbing vending machine, including a machine table and a plurality of bottle mounting frames, wherein an extract port is configured on a lower side of the machine table, a upper side of the machine table is configured with an accommodation space having a drop port in communication with the extract port, the drop port is configured with a detection element, a upper side of the accommodation space a crown block track allowing a gripper to be couple pivotally thereto and moved thereon, and the gripper is configured with non-slip elements and a hanging line capable of being wound to shorten and unwound to elongate, allowing the gripper to be lowered to the extract port; the machine table is further configured with an operation station having an operation lever and operation button, the operation lever and operation button being capable of operating and controlling the movement and beverage grab of the gripper; the machine table is also configured with: a coin slot, in electric connection with the operation station and gripper; and a refund button, the plurality of bottle mounting frames are installed in the accommodation space of the machine table, each bottle mounting frame is configured with a plurality of mounting holes each allowing a beverage can to be placed upright therein without toppling and falling, thereby providing a complex beverage grabbing vending machine capable of beverage sale and having game fun.

DETAILED DESCRIPTION OF THE PREFERRED EMBODIMENTS

Figure 1:
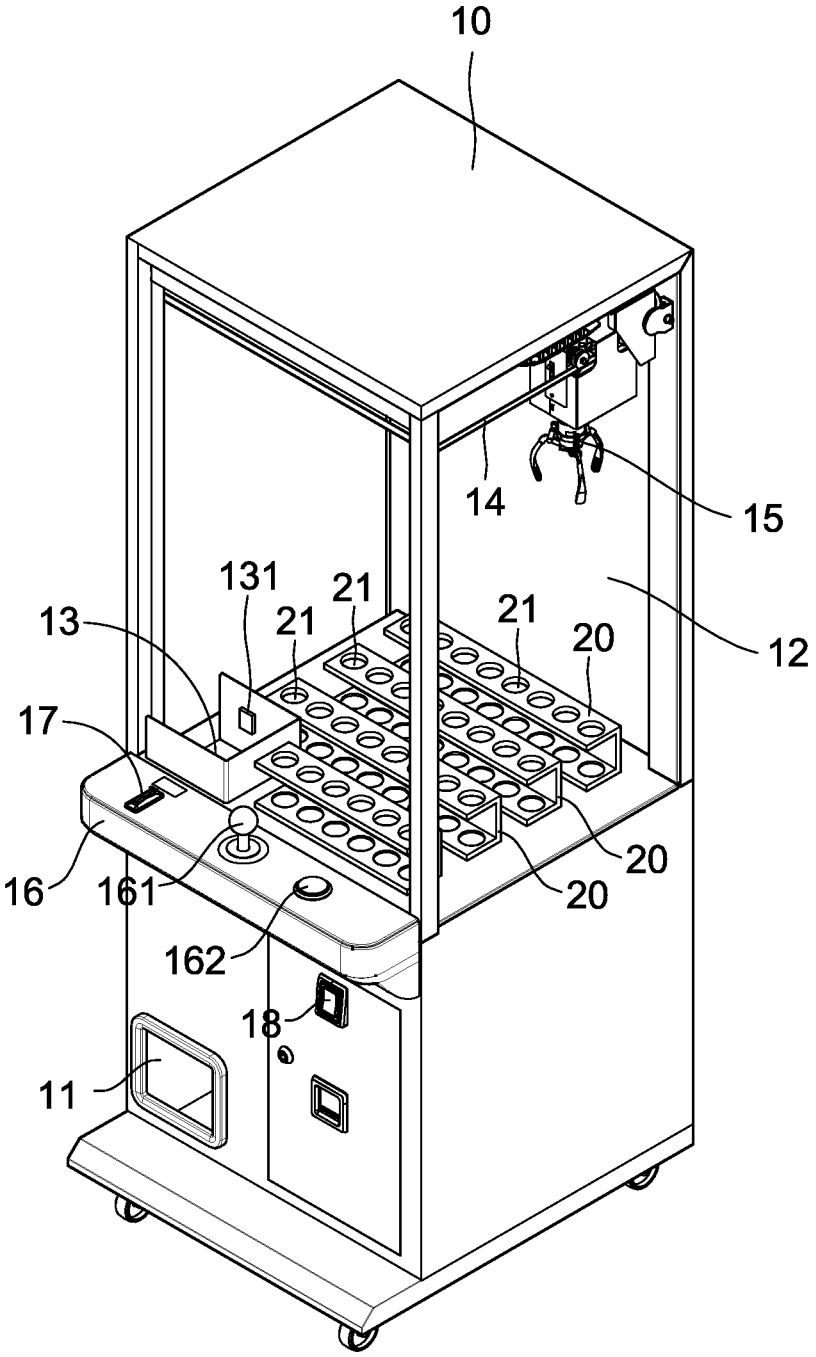
FIG. 1 is a perspective view of a complex beverage grabbing vending machine of the present invention.

Referring to FIG. 1, a complex beverage grabbing vending machine includes a machine table 10 and a plurality of bottle mounting frames 20.

Figure 2:
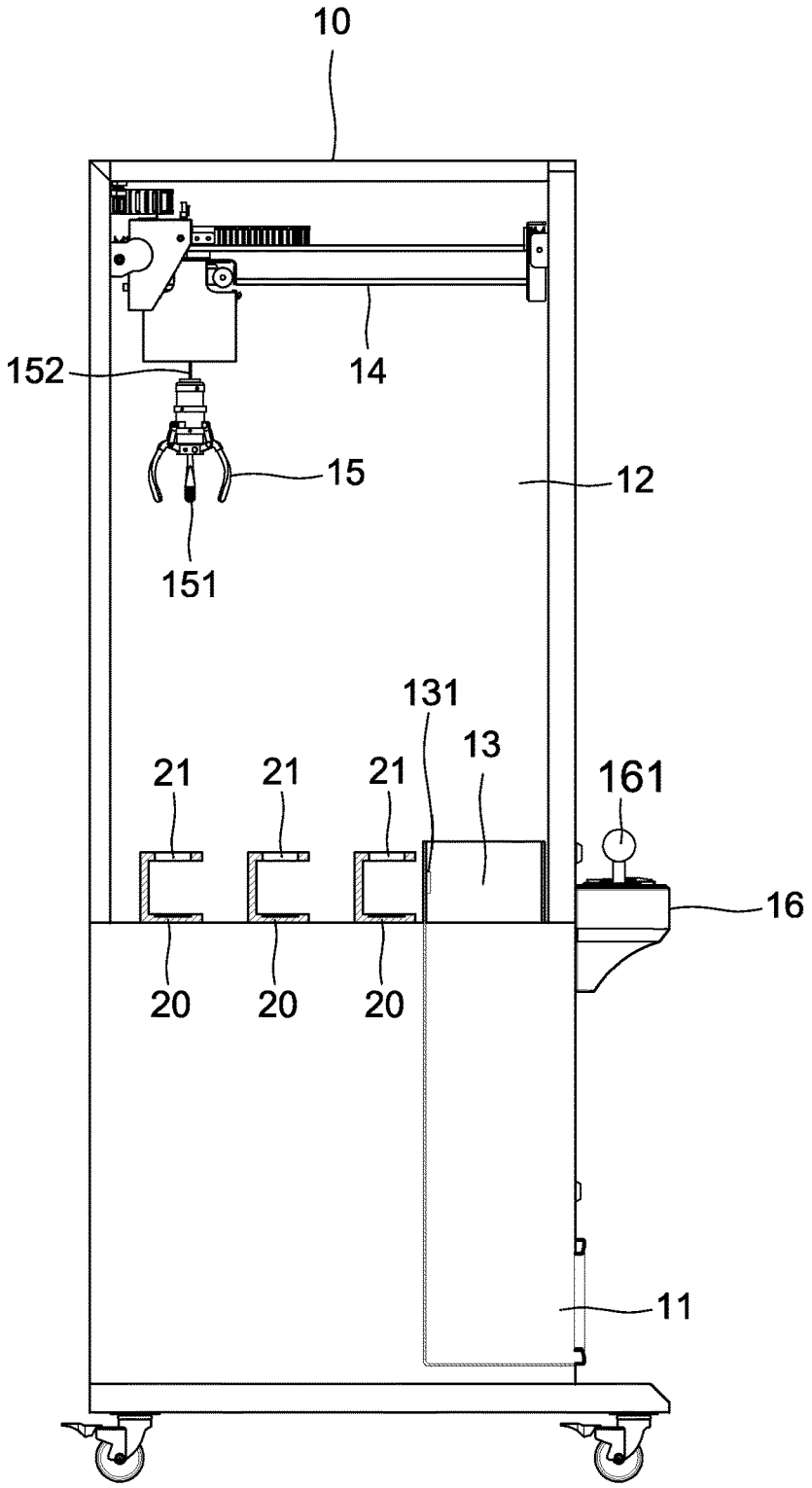
FIG. 2 is cross-sectional view of the complex beverage grabbing vending machine of the present invention.
Figure 3:
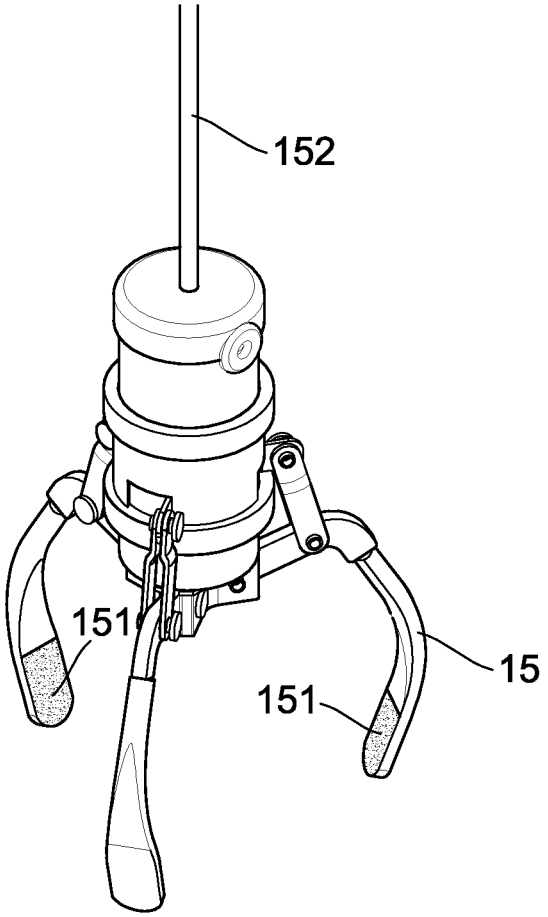
FIG. 3 is a perspective view of a gripper according to the present invention.

The machine table 10, also referring to FIGS. 2 and 3, is configured with an extract port 11 on the lower side thereof, and the upper side of the machine table 10 has an accommodation space 12, which is configured with a drop port 13 in communication with the extract port 11. Furthermore, the drop port 13 is configured with a detection element 131, and the upper side of the accommodation space 12 a crown block rack 14, to which a gripper 15 is coupled pivotally, where the gripper 15 can be moved on the crown block track 14 and is configured with anti-slip pieces 151. In addition, a hanging line 152 capable of being wound to shorten or unwound to extend is configured on the gripper 15, allowing the gripper 15 to be lowered up to extract port 11. Furthermore, the machine table 10 is configured with an operation station 16, on which an operation lever 161 and operation button 162 are configured, where the operation lever 161 and operation button 162 can control the movement and grab of the gripper 15; the machine table 10 is configured with a coin slot 17, which is in electric connection with the operation station 16 and gripper 15, and the machine table 10 is further configured with a refund button 18.

The bottle mounting frames 20, also referring to FIG. 2, are installed in the accommodation space 11 of the machine table 10, and each bottle mounting frames is configured with a plurality of mounting holes 21 each allowing a beverage can (bottle) 30 to be placed in, thereby enabling it to be stood upright without toppling and falling.

Figure 4:
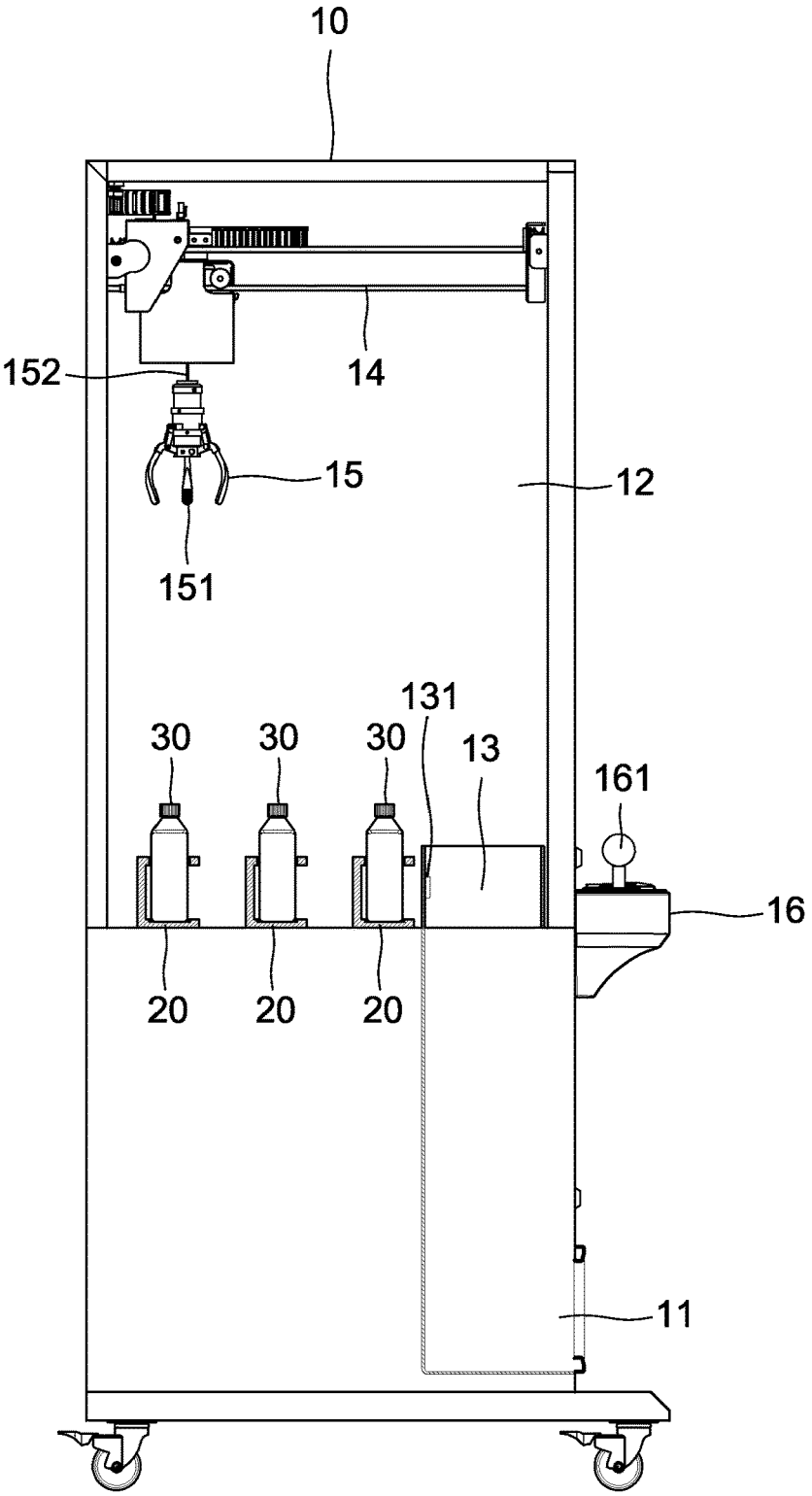
FIG. 4 shows beverages placed on bottle mounting frames of the complex beverage grabbing vending machine of the present invention.
Figure 5:
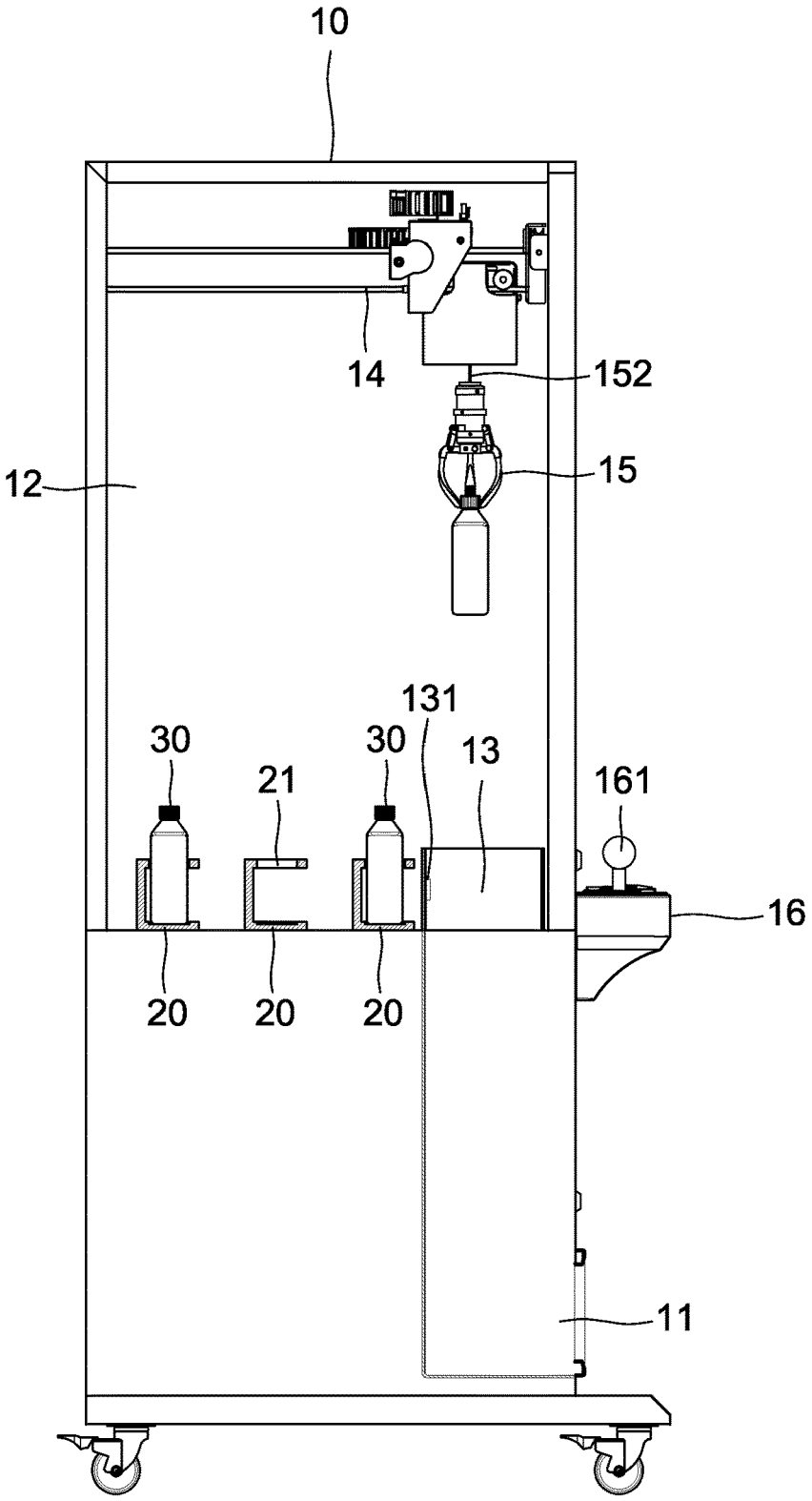
FIG. 5 is a cross-sectional view of the complex beverage grabbing vending machine of the present invention, where a beverage being caught by the gripper is shown.
Figure 6:
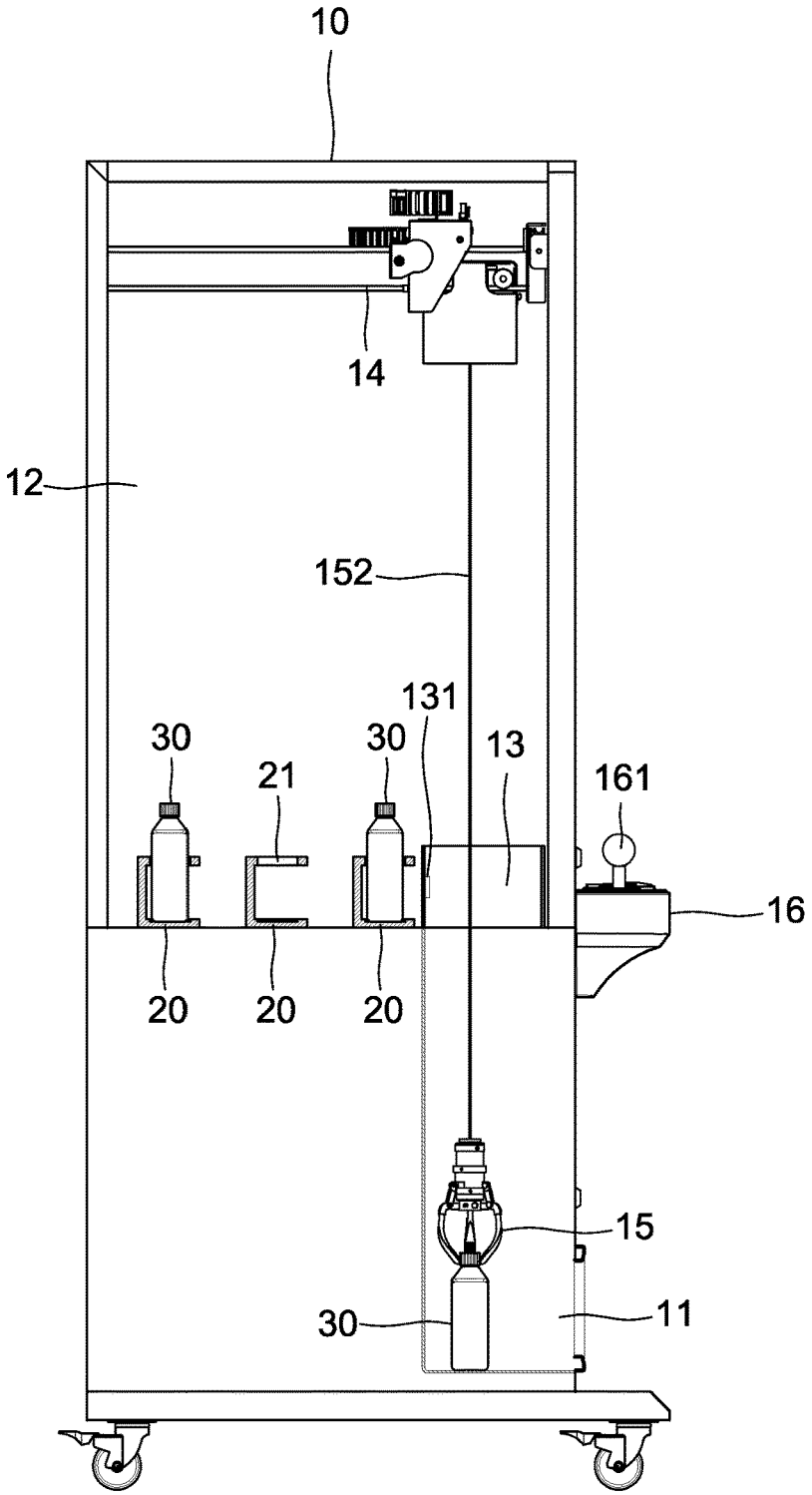
FIG. 6 is a cross-sectional view of the complex beverage grabbing vending machine of the present invention, where a beverage being released from the gripper to an extract port is shown.

With the structures mentioned above, the bottle mounting frames 20, as FIG. 4 shows, are used to mount the plurality of beverage cans (bottles) 30, allowing the beverage cans (bottles) 30 to be placed upright in the accommodation space 2 of the machine table 10. Next, a customer can grab the beverage to be purchased by controlling the operation lever 161 and operation button 162. Meanwhile, the beverage can (bottle) 30 can be avoided dropping down through the configuration of non-slip pieces 151 on the gripper 15 when it is caught by the gripper 15, allowing the gripper 15 to be lowered down to the extract port 11 through the unwinding and then the elongation of the hanging line 152 after the gripper 15 grabs the beverage can (bottle) 30 tightly and move it to the drop port 13 as FIG. 5 shows. Thereafter, the gripper 15 is loosened so as to place the beverage can (bottle) 30 in the extract port 11 as FIG. 6 shows and then raised and recovered through the winding and then the shortening of the hanging line 152 as FIG. 4 shows, and thus, the customer can then take out the beverage can (bottle) 30 purchased by gripping. In addition, with the configuration of the bottle mounting frames 20, the beverage can (bottle) 30 is unlikely to topple and fall due to collision or shaking so that a customer can grab the beverage to be purchase smoothly because the beverage can (bottle) 30 is placed upright in the mounting hole 21 of the bottle mounting frame 20 and thus limited and positioned by it even if the customer operates the gripper 15 improperly or mistakenly to cause it to hit the beverage can (bottle) 30.

Figure 7:
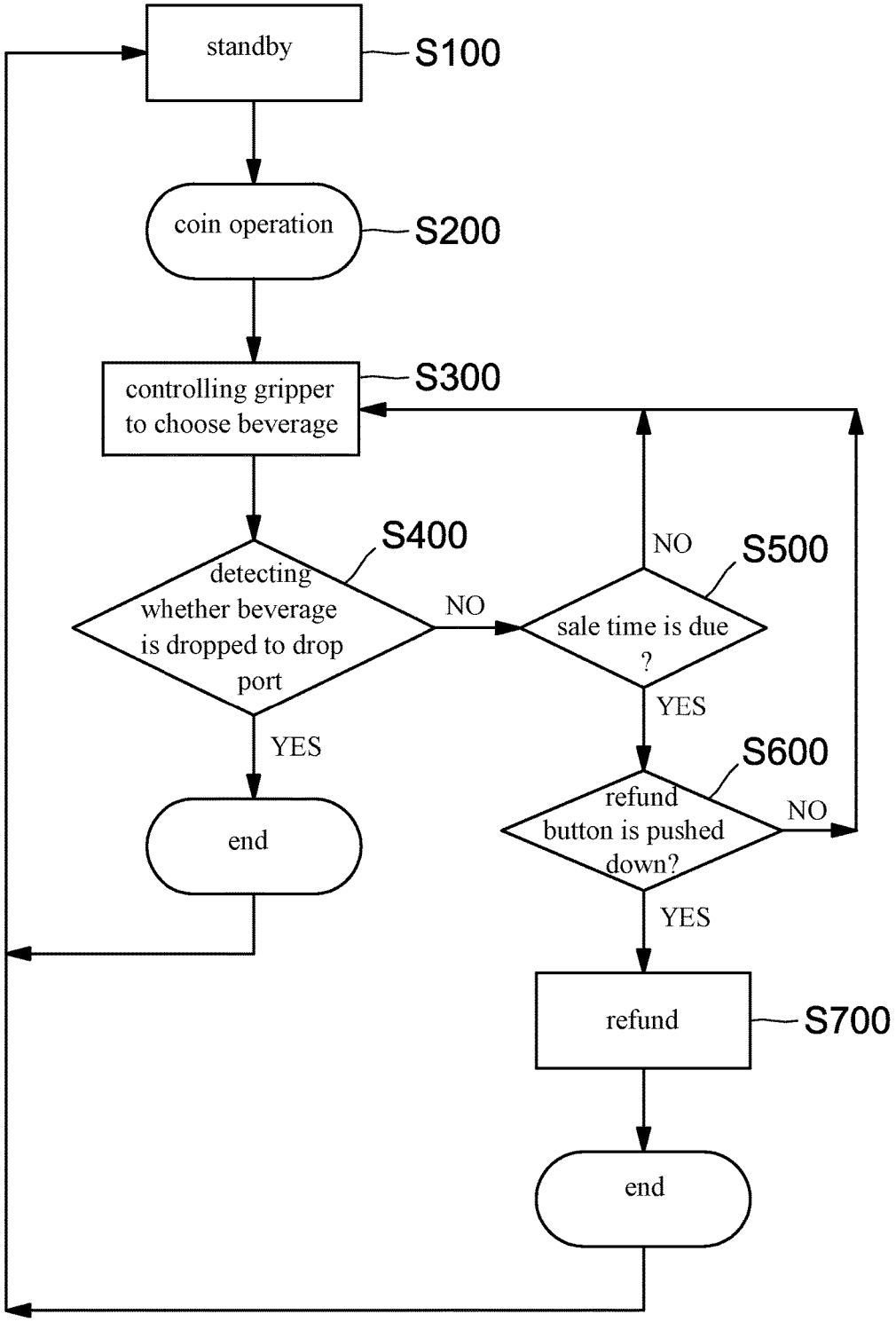
FIG. 7 is a flow chart, showing a method for selling beverages through the complex beverage grabbing vending machine of the present invention

In order to allow a customer to grab and purchase a drink product smoothly with the vending machine of the present invention, a beverage sale method according to the present invention, as FIG. 7 shows, has the following steps:

S100 (standby): turning on the machine table 10, and leaving the gripper 15 and operation station 16 to be in a standby state without operation thereof;

S200 (coin operation): putting a coin or coins into the slot 17 by a consumer to make the gripper 15 and operation station 17 be in electric connection with each other, thereby operating and controlling the gripper 15 to start gripping a beverage;

S300 (controlling the gripper to choose a beverage): operating the gripper 15 to move and grip a beverage by the customer, allowing the customer to pick up a drink product to be purchased;

S400 (detecting whether a drink product drops through the drop port): detecting whether a drink product passes through the drop port 13 after the gripper 15 is moved to the drop port 13; if yes, this gripping purchase is completed and returning to the standby state of S 100; if not, entering the next step;

S500 (checking whether sale time is due): checking whether preset sale time (e.g. 1 minute) of this gripping purchase is due when a drink product being passed through the drop port 13 is not detected; if not, returning to S300 of controlling the gripper to choose a beverage, the customer can restart controlling the gripper 15 to perform the gripping purchase; it yes, the gripper 15 and the operation lever 161 and operation button 162 of the operation station 16 are powered off and the motions thereof are stopped, and then entering the next step;

S600 (checking whether the refund key is pushed down): checking whether the refund key 18 is pushed down when the gripper 15 and the operation lever 161 and operation button 162 of the operation station 16 are powered off; if not, returning to S300 of controlling the gripper to choose a beverage to restart the gripping purchase; if yes, entering the next step; and S700 (refund): refunding coin to the customer when the system senses the pushing-down of the refund button 18 to cause the gripper 15 and the operation lever 161 and operation button 162 of the operation station 16 to be powered off; this gripping sale ends, and returning the system to the standby state of S100.

With the above steps, a customer can use the above devices to operate the gripper 15 to grab and purchase a drink product. A drink product can be prevented from slipping and falling down upon the movement of the gripper 15 through the non-slip pieces 151 configured on the gripper 15 after the customer picks up the drink product with the gripper 15, and the gripper 15 is lowered down to the extract port 11 to place the drink product therein after the gripper 15 is moved to the drop port 13, which can prevent the drink product from being hollowed and damaged due to falling impact, allowing the customer to take out the well-packed drink product from the extract port 11. In addition, the detection element 131 configured on the drop port 13 detecting whether a drink product passes through the drop port 13 can be used to judge whether the customer is allowed to operate the gripper 15 to grip a drink product once more; a customer is allowed to operate the gripper 15 to grab a drink product again if they do not get a drink product at first time, and they are even allowed to operate the gripper 15 to get the product if they still grab none at second time, and so on; the gripper 15 is reset and stopped motion after the customer grabs none for a long time and the preset sale time for gripping (e.g. 1 minute) is due, and the customer also cannot operate the gripper 15 any more through the operation lever 161; the system judges whether the refund button 18 configured on the machine table 10 is pushed down; if the customer does not purchase a drink product by gripping any more, they can push down the refund key 18 to return the coin, and then ends the gripping purchase. But, if the customer wants to continue the gripping purchase and still does not push down the refund key 18, the gripper 15 is in electric connection with the operation lever 161 and operation button 162 of the operation station 16 again after the system makes sure that the refund key 18 is not pushed down, and thus, the customer is allowed again to purchase a drink product by gripping with the gripper so that the gripping purchase is performed and whether the preset sale time is due is checked again.

Therefore, the present invention using the gripper 14 to grab a drink product not only provides a customer with the purchase of a drink product but achieving a game effect in the process of grabbing the product by controlling the gripper 15, truly having both sale and entertainment effects. The present invention changes the one-way sale of conventional vending machines by operating the gripper to grab a drink product through a customer, which can improve the interaction between the customer and machine, not only having the purpose of selling beverage but improve the fun and two-way interaction of customer's shopping. In addition, the bottle mounting frames 20 being configured on the machine table 10 allows drink products to be placed upright, which prevents the drink products from toppling and falling due to collision so that the customer can grab a drink product which is placed upright accurately in the first place.

I claim:

1. A method for selling beverages through a complex beverage grabbing vending machine, comprising steps of:

standby: turning on a machine table and leaving a gripper and an operation station in a standby state without operation;

coin operation: putting a coin or coins into a coin slot by a customer, allowing said gripper and said operation station to be in electric connection with each other, thereby operating and controlling said gripper to start purchase by grab;

controlling said gripper to choose a beverage: controlling said gripper to move and grab said beverage by said customer, allowing said customer to grab said beverage to be purchased;

detecting whether said beverage passes through a drop port:

detecting whether said beverage passes through said drop port after said gripper is moved to said drop port; if yes, ending a gripping purchase;

checking whether sale time is due: checking whether a preset purchase time is due when said beverage passing through said drop port is not detected, if not, returning to the step of controlling said gripper to choose said beverage, controlling said gripper again to perform said gripping purchase by said customer; if yes, powering off said gripper and an operation lever and an operation button of said operation station and stopping the motions thereof;

checking whether a refund button is pushed down: detecting whether said refund button is pushed down when said sale time is due and said gripper and said operation lever and said operation button of said operation station are powered off; if not, returning to the step of controlling said gripper to choose said beverage to start said gripping purchase again; if yes, starting refund; and refund: starting refund when said refund button being pushed down is detected, ending said gripping purchase, and returning to said standby state.

* * * * *